US008875888B2

(12) United States Patent
Koenig et al.

(10) Patent No.: US 8,875,888 B2
(45) Date of Patent: Nov. 4, 2014

(54) STACKABLE CONTAINER ASSEMBLY WITH RECIPROCAL LOCKING OF THE STACKED CONTAINERS

(75) Inventors: Andreas Koenig, Leipheim (DE); Raimund Schäffer, Ulm (DE); Timo Kuhls, Stuttgart (DE); Lutz Wolle, Burlafingen (DE)

(73) Assignee: TTS Tooltechnic Systems AG & Co. KG, Wendlingen (DE)

( * ) Notice: Subject to any disclaimer, the term of this patent is extended or adjusted under 35 U.S.C. 154(b) by 260 days.

(21) Appl. No.: 13/061,161

(22) PCT Filed: Jun. 29, 2009

(86) PCT No.: PCT/EP2009/004668

§ 371 (c)(1),
(2), (4) Date: Feb. 28, 2011

(87) PCT Pub. No.: WO2011/000385

PCT Pub. Date: Jan. 6, 2011

(65) Prior Publication Data

US 2011/0155613 A1 Jun. 30, 2011

(51) Int. Cl.
*B65D 21/02* (2006.01)

(52) U.S. Cl.
CPC ..... *B65D 21/0223* (2013.01); *B65D 2525/288* (2013.01)
USPC ..... 206/508; 206/503; 206/511

(58) Field of Classification Search
CPC .. B65D 21/02; B65D 21/032; B65D 21/0223; B65D 2525/288
USPC ..... 206/508, 425, 503, 511; 220/380, 761, 220/781
See application file for complete search history.

(56) References Cited

U.S. PATENT DOCUMENTS

| | | | | |
|---|---|---|---|---|
| 2,634,020 | A | 4/1953 | Bartholomew | |
| 3,182,856 | A | 5/1965 | Goltz | |
| 3,387,732 | A | 6/1968 | Jellies | |
| 3,581,928 | A | 6/1971 | St. Amand | |
| 4,351,448 | A * | 9/1982 | Ingersoll et al. | 220/318 |
| 5,353,948 | A | 10/1994 | Lanoue et al. | |
| 5,469,961 | A * | 11/1995 | Chang | 206/312 |
| 5,606,820 | A | 3/1997 | Suddeth | |
| 5,699,925 | A | 12/1997 | Petruzzi | |

(Continued)

FOREIGN PATENT DOCUMENTS

| | | |
|---|---|---|
| BE | 378243 | 4/1931 |
| DE | 4201264 | 7/1993 |

(Continued)

*Primary Examiner* — Anthony Stashick
*Assistant Examiner* — Ernesto Grano
(74) *Attorney, Agent, or Firm* — Hoffmann & Baron, LLP

(57) ABSTRACT

It is a matter of a container assembly with at least one stackable container (1) which has a bottom part (7) and a lid (8) mounted on top thereof Several containers (1) may be so stacked that the lid (8) of the lower container (1) is located between two bottom parts (7). The container (1) is equipped with at least one connecting device (3) which has coupling means (26) mounted movably on the lid (8) of the container (1). The coupling means (26) are movable, for the connection of two containers (1) mounted one above the other, into a connected position relative to the lid (8), in which they are simultaneously in connecting engagement with the bottom parts (7) of both stacked containers (1).

41 Claims, 8 Drawing Sheets

(56) References Cited

U.S. PATENT DOCUMENTS

| | | | | |
|---|---|---|---|---|
| 5,755,180 | A | 5/1998 | Smith | |
| 6,761,266 | B2 | 7/2004 | Popish | |
| 6,959,507 | B2 | 11/2005 | Bazany et al. | |
| 7,246,718 | B2 * | 7/2007 | Einav et al. | 220/764 |
| 2003/0155267 | A1 | 8/2003 | Mercier et al. | |
| 2005/0224494 | A1 | 10/2005 | Heinrichs | |
| 2008/0308641 | A1 | 12/2008 | Finn | |
| 2009/0139892 | A1 | 6/2009 | Vovan et al. | |
| 2009/0178989 | A1 | 7/2009 | Accuardi | |
| 2009/0236255 | A1 * | 9/2009 | Piacenza et al. | 206/508 |

FOREIGN PATENT DOCUMENTS

| | | | | |
|---|---|---|---|---|
| DE | 4409411 | | 9/1995 | |
| DE | 29922447 | | 5/2000 | |
| DE | 20104892 | | 10/2001 | |
| DE | 20112393 | | 11/2001 | |
| DE | 20119308 | | 3/2002 | |
| DE | 20319100 | | 4/2004 | |
| DE | 102007032382 | | 1/2008 | |
| DE | 102007032382 | A1 * | 1/2008 | A47J 47/02 |
| EP | 0043540 | | 1/1982 | |
| EP | 055533 | | 8/1994 | |
| EP | 0997234 | | 5/2000 | |
| EP | 1059240 | | 12/2000 | |
| EP | 1059240 | | 2/2003 | |
| EP | 1 516 703 | A1 * | 3/2005 | B25H 3/02 |
| EP | 1516703 | | 3/2005 | |
| EP | 1752262 | | 2/2007 | |
| EP | 2020188 | | 2/2009 | |

* cited by examiner

STACKABLE CONTAINER ASSEMBLY WITH RECIPROCAL LOCKING OF THE STACKED CONTAINERS

This application claims priority based on an International Application filed under the Patent Cooperation Treaty, PCT/EP2009/004668, filed Jun. 29, 2009.

BACKGROUND OF THE INVENTION

The invention relates to a container assembly, with at least one stackable container which has a box- or bowl-shaped bottom part with an opening, and a lid assigned to the opening of the bottom part and movable relative to the bottom part for either opening or closing the opening, and designed for the vertical stacking of several containers in such a way that the lid of a lower container comes to lie between the bottom parts of the lower container and an upper container positioned immediately above, wherein the container is provided with at least one connecting device which has a movable connecting means, by which the bottom parts of containers resting directly on top of one another may be connected releasably together to obtain a container unit comprised of several containers.

An existing container assembly of this kind known from EP 1 059 240 B1 includes a container with a bottom part and a lid mounted pivotably on the former. This container may be stacked together with several similar containers in such a way that its lid comes to lie beneath the bottom part of a lid resting on top of it. On opposite side end faces of the container there is provided in each case a connecting device comprised of two connecting means in the form of rotating locking bolts, one of which is mounted on a pivotable carrying handle. Depending on the pivoted position of the carrying handle, the lid is locked to or released from the lid by the connecting means of the carrying handle. To connect two stacked containers to one another to obtain a uniformly transportable container unit, the second connecting means may be similarly rotated so that it makes connecting engagement with the bottom part of the upper container. The cohesion between two connected containers is thus effected through the connection of the two bottom parts. If such a container unit is transported by taking hold of the upper container, the pivotable mounting of the connecting means is subjected to a heavy load which can lead to premature wear, but at least requires a very stable and robust and therefore costly design.

A comparable situation exists with the container assembly described in EP 0 555 533 B1, which discloses a stackable container equipped with connecting devices distributed over its periphery, each having connecting means in the form of a pivotable locking tab. Here, differing from EP 1 059 240 B1, a single connecting means is able either to lock just the lid to the bottom part, or to join several containers to an upper container by means of locking engagement to form a container unit. In the case of such a container unit, once again the movable support of the connecting means is subject to a heavy load, so that additional anchoring means are provided on the bottom part and relieve its pivotable mounting means through interaction with the connecting means. Associated with this is an increased cost of manufacture.

Known from DE 44 09 411 A1 is a packing container which may be stacked with others of its kind and made into a container unit through complementary engaging structures on its top and bottom sides, which engage with one another when an upper container is placed on a lower container in a combined insert and turn movement. The engaging structure prevents the upper container from being lifted off in certain areas, in the vicinity of the rear of the container. Fixing of the front section of the container is effected by means of an additional connecting device, which has several connecting means in the form of rotating locking bolts which may be rotated in such a way that they create a connecting engagement between the front sections of the stacked containers. In this packing container, the container opening is arranged at the side and may be closed by means of two cover panels which can be placed over one another and are mounted pivotably on the body of the container. The rotatable connecting means allow simultaneous locking of the cover panels to one another and to the cover panels of the next container above.

The problem of the present invention is to create a container assembly in which the stackable container is equipped with means which may be produced at low cost and which, with simple operation, allow a stable connection of containers stacked on top of one another.

SUMMARY OF THE INVENTION

To solve this problem it is provided that the movable connecting means of the one or more connecting devices is mounted on the lid of the container and, to connect the container to a container placed on top of it, may be moved relative to the lid into a connected position in which it is simultaneously in connecting engagement with the bottom parts of both stacked containers.

Since the connecting means mounted movably on the lid is in the connected position simultaneously in connecting engagement with both bottom parts flanking the lid, the bearing force occurring due to the connecting means when a container unit is transported is transferred at least mainly directly between the bottom parts, so that the bearing means provided on the lid for movement support of the connecting means are relieved of stress.

These bearing means are therefore not subject to any increased wear and have no special requirements in terms of stability, which favours cost-effective manufacture. Operation of the connecting device is moreover very simple, since connection and release of two containers lying on top of one another may be effected more or less with just one movement of the hand. Preferably a single handling operation involving the connecting means is sufficient to bring both the bottom part of the assigned lid and also the bottom part of the upper lid lying on top into connecting engagement ensuring firm cohesion in the stacking direction.

Advantageous developments of the invention are set out in the dependent claims.

Expediently the movable connecting means of the connecting device is in the form of a rotating locking bolt, in particular one-piece, mounted rotatably on the lid. The desired connecting engagement may therefore be made or released by simple turning of the rotating locking bolt. In the connected position, the rotating locking bolt acts simultaneously on anchoring means of both containers arranged on top of one another, thereby ensuring stable cohesion.

The anchoring means provided on the bottom part of the container are expediently divided into first and second anchoring means spaced apart in the stacking direction. The first anchoring means lie closer to the lid than the second anchoring means. In this way, the rotating locking bolt of a lower container in the connected position may cooperate on the one hand with the first anchoring means of the bottom part of the lower container, and simultaneously with the second anchoring means of the bottom part of the upper container. An advantage of this design is that the rotating locking bolt may be made with compact dimensions irrespective of the overall height of the container.

For interaction with the anchoring means provided on the bottom part, the rotating locking bolt expediently has suitable locking structures. These are, like the anchoring means, expediently curved, with the curve centre points lying in particular on the rotation axis of the rotating locking bolt. By this means, the locking and unlocking process can take place very easily and it is possible at the same time to ensure in the connected position a curved contact over a large area between the locking structures and the anchoring means, so that even with a high loading force to be transferred, only minimal surface pressure occurs.

The anchoring means are preferably in the form of projections, in particular one-piece elements of the bottom part. The locking structures are expediently integral parts of groove-like recesses formed in the rotating locking bolt.

The connecting device may advantageously have a multiple function. Thus, the movable connecting means is designed in particular so as to be movable not only into the connected position but also at least into a closed position in which the connecting engagement with any upper container mounted on the container is released, while however maintaining connecting engagement with the bottom part located beneath the lid. The closed position is therefore that position in which the rotating locking bolt may be shifted if it is intended to place an upper container on the lower container, or to remove an upper container from the lower container. The closed position is moreover that position which ensures cohesion between lid and bottom part, when the container is to be transported on its own.

In the case of an embodiment as rotating locking bolt, the closed position is a rotary position relative to the lid which differs from the connected position. Expediently provided on the rotating locking bolt are locking structures, offset in its direction of rotation, which in the connected position and in the closed position are alternately in connecting engagement with one and the same anchoring means located on the bottom part. If the anchoring means have first and second anchoring means of the type described above, then the rotating locking bolt expediently cooperates in the connected position and in the closed position with the first anchoring means in each case.

The locking structures cooperating alternately in the connected position and in the closed position with the anchoring means of the bottom part are expediently offset on the rotating locking bolt in the direction of rotation in such a way that the rotating locking bolt may be rotated into an open position in which the aforementioned anchoring means lie between the locking structures and the latter are as it were able to move past the anchoring means, to permit raising or lowering of the lid from or on to the bottom part, when the opening of the bottom part is to be either opened or covered.

Another function which may be integrated in the connecting device or devices is the creation of connecting engagement with only the bottom part of an upper container mounted on the lid, with simultaneous removal of the connecting engagement to the bottom part arranged beneath the lid. In this position which may be described as the semi-connected position it is possible to swing the lid of the container upwards even when another container is mounted on this lid, with this further container remaining fixed to the raised lid so that the container unit does not need to be broken up.

If the connecting means are in the form of a rotating locking bolt then the semi-connected position corresponds expediently to a rotary position which is rotated through 90° relative to the connected position.

Although it would be possible in principle to make the lid so that it is removable from the bottom part in its entirety, a design with swivel mounting relative to the bottom part is recommended, so that the lid may be swivelled to open and close the container.

It is possible to equip the container with several connecting devices of the type described, which are then expediently placed at several points distributed along the periphery of the container. In particular if only such connecting devices are used to create the container unit, it is expedient to provide in each case at least one connecting device on at least two opposite end faces of the container.

In an advantageous manner, at least one connecting device of the type described may be combined with other measures for creating a cohesive container unit of stacked containers.

Such additional measures may involve in particular the provision of a first engaging structure on the top of the lid and a second engaging structure on the underside of the bottom part. These two engaging structures are matched to one another in such a way that, when two containers are resting on top of one another, the first engaging structure of the lower container lying on top, and the second engaging structure of the upper container lying below, engage in one another in such a way that the two containers are on the one hand secured against shifting relative to one another at right-angles to the stacking direction, and on the other hand through localised locking, lifting of the upper container from the lower container at certain points is prevented. The latter feature is obtained by the locking engagement of special rear-engaging or behind engaging elements of the engaging structures, with this locking engagement being produced through a relative movement of the two containers when an upper container is placed on the lower container. The connecting device or devices according to the invention is or are arranged with clearance from the locking area defined by the rear-engaging elements cooperating with one another, and hold the two containers together in the connected position in such a way that the upper container is also connected in that area, vertically immobile, to the lower container, which is not prevented by the engaging structure from being lifted. Consequently there is a combined effect between the engaging structures on the one hand and the connecting device or devices on the other hand.

Preferably the first engaging structure provided on the lid consists of engaging recesses and the second engaging structure on the bottom part is made up of engaging projections. In an advantageous manner, the engaging projections are at the same time designed as feet, on which the container may be stored stably when not stacked on another container. These feet also form expediently at least partly the rear-engaging elements of the second engaging structure which, for stacked containers, prevent localised lifting from the lower container by engaging in a first engaging structure. Feet equipped with this rear-engaging function may be described as locking feet. Other feet which, interacting with the first engaging structure, provide only protection against shifting at right-angles to the stacking direction, may be described as supporting feet.

Preferably provided on the underside of the bottom part, in particular towards the rear, are two locking feet spaced apart from one another. In order to ensure reliable locking engagement even with wear, a locking strip extending between the two locking feet may also be provided; when two containers are stacked, this strip is also interlocked with a rear-engaging element of the first engaging structure of the lid.

For interaction with the locking feet, the first engaging structure expediently has at least one locking engaging recess with a relief-cut cross-section and a rear-engaging projection on its edge, which is able to make locking engagement with the assigned locking feet and also, if provided, with a locking strip. A single locking engaging recess may be so designed as to facilitate the simultaneous engagement of all locking feet provided. In particular a locking engaging recess designed in this way may also undertake the additional function of a handgrip recess in which it is possible to reach with one hand in order to carry the container. In particular with relative flat containers, i.e. comparable in size to a briefcase, the container may also be transported very easily in this way in an upright position similar to a briefcase.

Apart from that, the container is expediently equipped with a carrying handle in the area of its upper side, which may expediently be swivelled into an out-of-use position in which it is swivelled into a locating recess formed on the top of the lid. This locating recess is formed expediently by a suitably large engaging recess of the first engaging structure, which makes it easier to produce and which, amongst other things, also favours its use if required as a handgrip recess.

The container assembly may have several containers of the type described, differing from one another in particular in their height but identical in respect of their connecting device and expediently also the engaging structures, so that they may be stacked in any desired combination and order, and linked to form a container unit.

BRIEF DESCRIPTION OF THE DRAWINGS

The invention is explained in detail below with the aid of the appended drawing, which shows in.

DETAILED DESCRIPTION OF THE PREFERRED EMBODIMENTS

Figure 1:
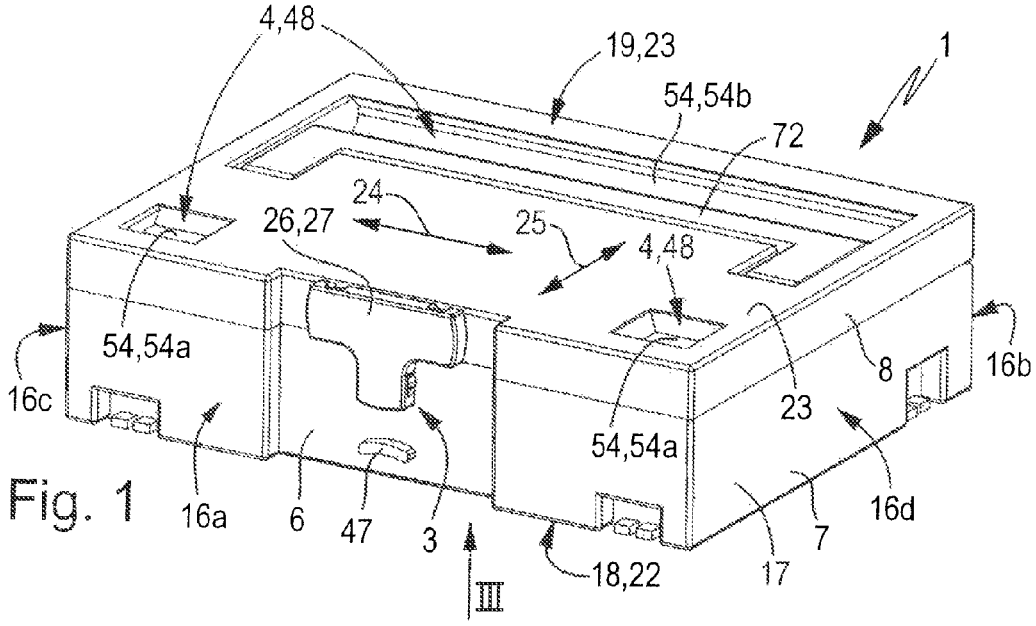
FIG. 1 a perspective view of a container according to the invention in the closed state FIG. 2 the container of FIG. 1 with the lid swung into an open position FIG. 3 a view of the container from below, looking in the direction of arrow III of FIG. 1

The container assembly depicted in FIGS. 1 to 4 comprises a container 1 which is designed to produce, by stacking on top of one another in a stacking direction 2, in particular vertical, several containers 1 of its kind, a container assembly comprising several containers 1 resting one on top of the other, as evident by way of example from FIGS. 5 to 10.

The container 1 is preferably also equipped with at least one connecting device 3 and with an engaging device 4 which allow the releasable connection to one another of cases resting on one another in such a way that the container assembly forms a container unit consisting of several connected containers 1, which may be handled and in particular transported as a unit.

The container 1 is expediently substantially rectangular in shape. Inside it has a storage space 5 to hold articles of any kind. Its body 6 is expediently divided into a box- or shell-shaped bottom part 7 and a lid 8 assigned to the opening 12 of the bottom part 7 and which may in turn also be box- or shell-shaped.

In the normal position of use of the container 1, the bottom part 7 is at the bottom and the lid 8 is on top. The present description relates to this normal position of use.

Figure 5:
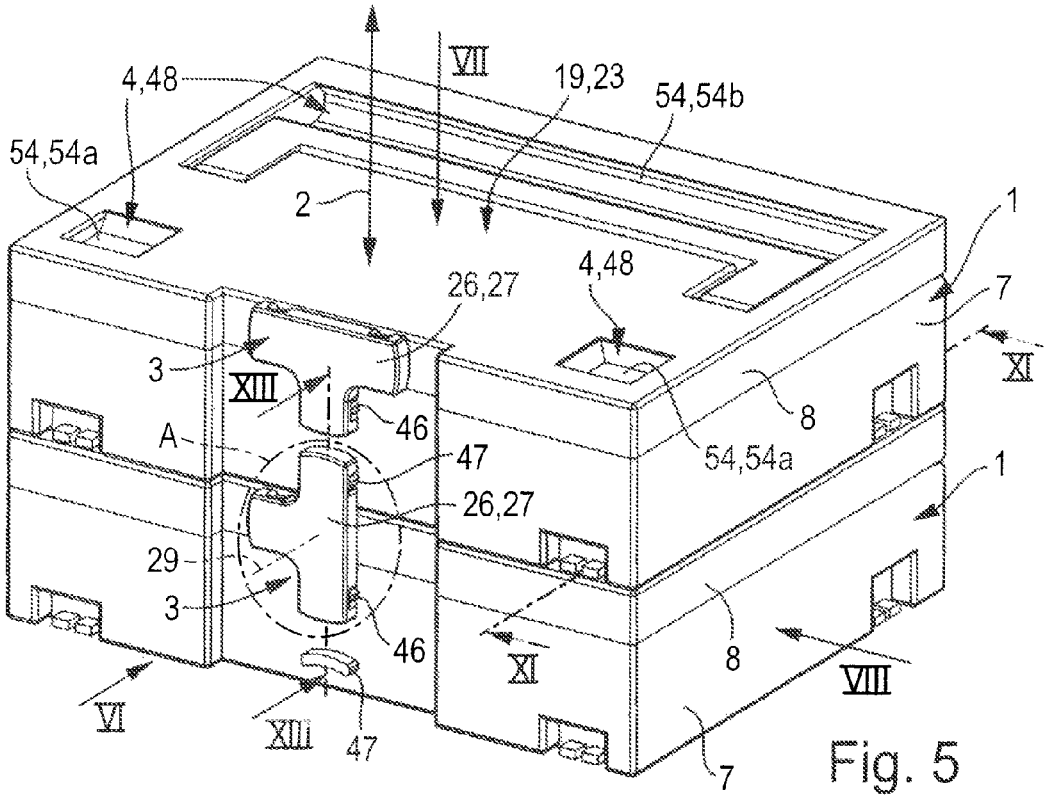
FIG. 5 a container assembly consisting of two stacked containers, connected to form a container unit FIG. 6 a front view of the assembly of FIG. 5 looking in the direction of arrow VI FIG. 7 a top view of the container assembly of FIG. 5 looking in the direction of arrow VII FIG. 8 a side view of the assembly of FIG. 5 looking in the direction of arrow VIII FIG. 9 the container assembly of FIG. 5 from a different angle of view and with the connecting means of a connecting device removed FIG. 10 the container assembly of FIG. 5 in a perspective side view, with an upper container being placed on a lower container FIG. 11 a cross-section through the container assembly along section line XI-XI of FIGS. 5 and 6 in the area of the engaging structures in engagement with one another FIG. 12 a detail view of connecting means in a rear view looking in the direction of arrow XII of FIG. 9

The lid 8 may adopt a covering position relative to the bottom part 7, as seen for example in FIGS. 1 and 5. Here it sits completely on the edge of the bottom part 7 and seals the opening 12, so that the storage space 5 is covered and inaccessible.

Figure 2:
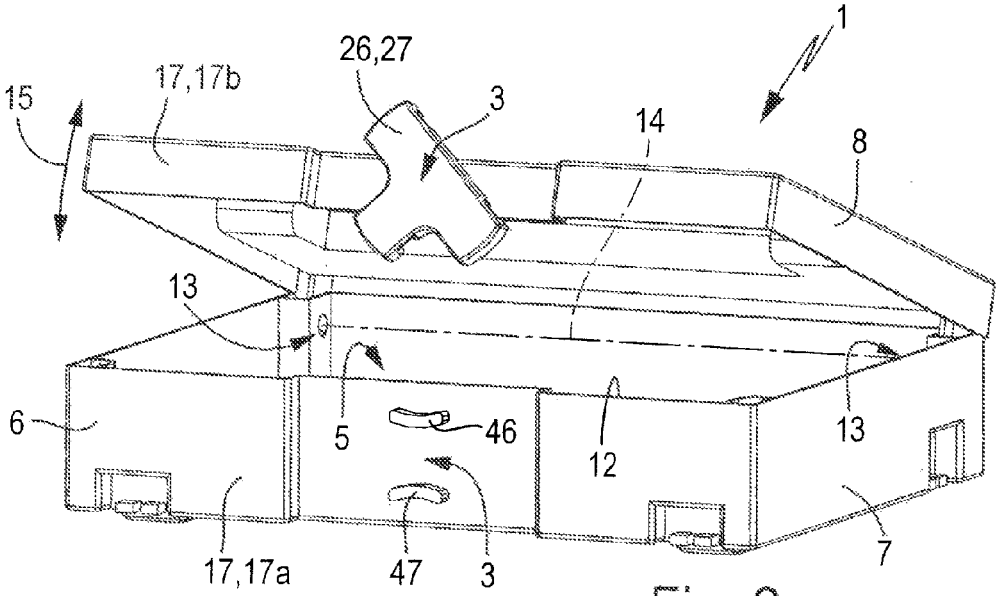
Figure 3:
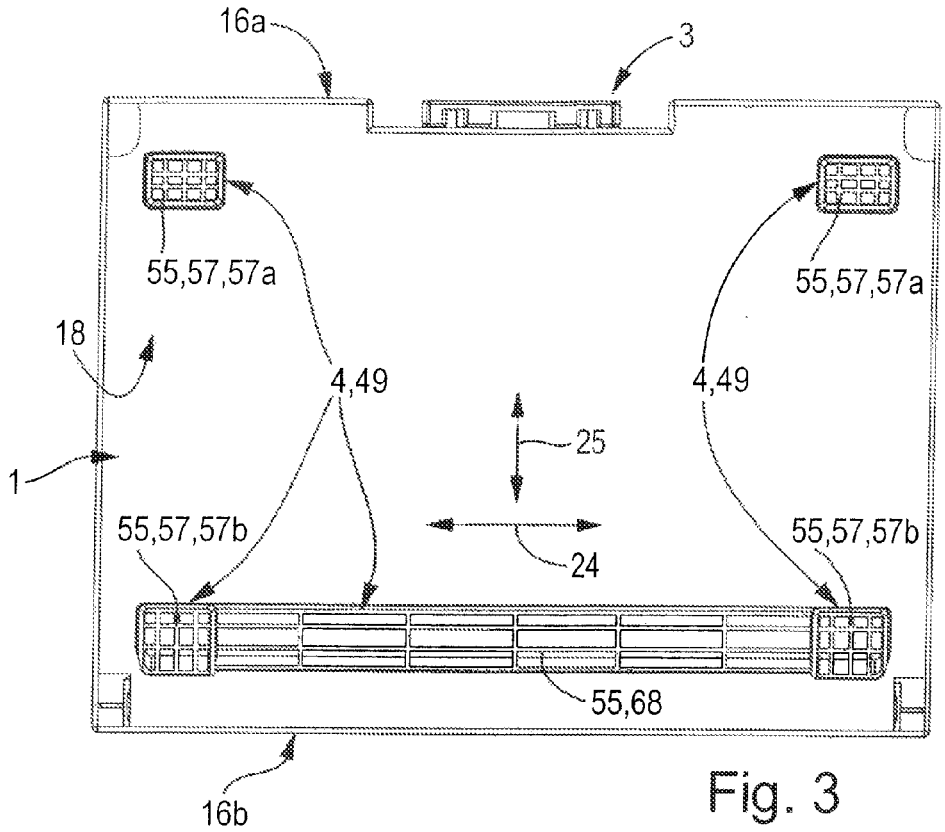
Figure 9:
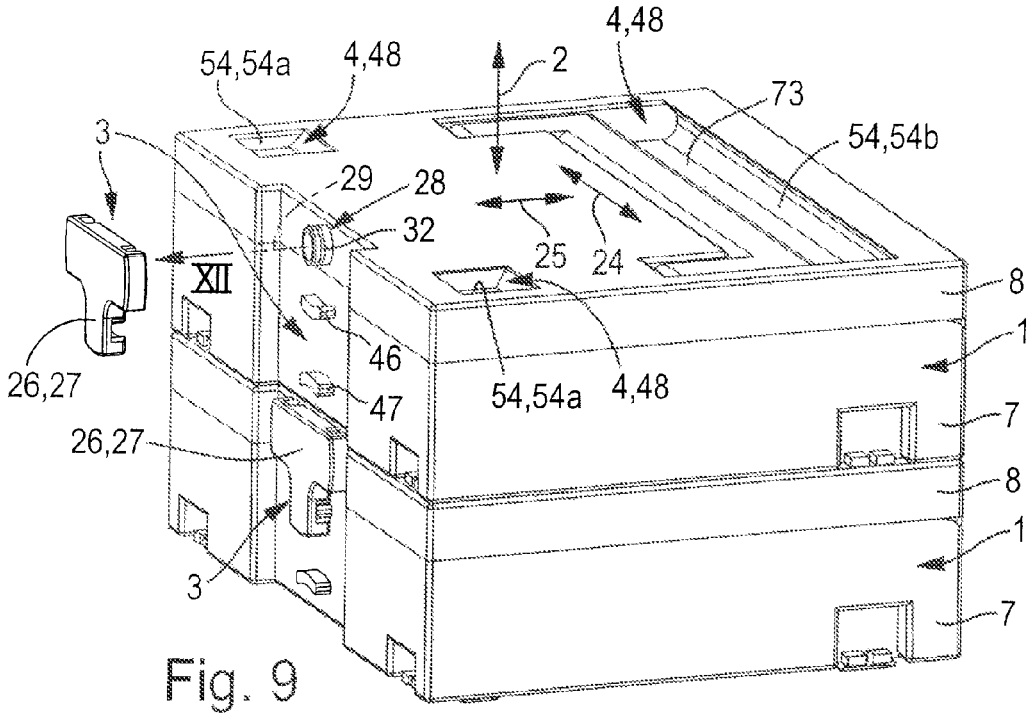

On the other hand, the lid 8 may also be moved away from the bottom part 7, into an open position seen for example in FIGS. 2 and 9, in order to free the opening 12 and amke the storage space 5 accessible.

In principle, no permanently connected link is required between the bottom part 7 and the lid 8, which would allow complete removal of the lid 8 from the bottom part 7 to obtain an open position. It is however expedient to fix the two components to one another in such a way that they also represent a cohesive assembly in the open position of the lid 8. Exemplarily, this is obtained through a pivotable mounting of the lid 8 on the bottom part 7 using hinge means 13, which define a lid swivel axis 14 around which the lid 8 may be pivoted according to double arrow 15 in the vertical direction of the container 1, in order to open and close the container 1.

Based on the normal position of use, the container 1 has on its outside a front end face 16*a*, an opposite rear end face 16*b*, together with two similarly opposite side end faces 16*c*, 16*d* running between the front and rear end faces 16*a*, 16*b*. These end faces 16*a*-16*d* are part of a frame-like peripheral wall 17, which in the embodiment is divided into a peripheral wall section 17*a* belonging to the bottom part 7 and a peripheral wall section 17*b* belonging to the lid 8. With the container 1 closed, the two peripheral wall sections 17*a*, 17*b* are expediently flush with one another.

The exterior of the container 1 also has a lower outer surface described as the underside 18 and an upper outer surface described as the top side 19. The underside 18 is part of a bottom surface 22 belonging to the bottom part 7, while the top side 19 is part of a top panel 23 belonging to the lid 8. The bottom surface 22 and the top panel 23 both extend in the normal position of use in a horizontal plane, while the stacking direction 2 which coincides with the vertical direction of the container 1 is oriented at right-angles to the former.

If, as may be seen in FIGS. 5 to 19, two containers 1 are stacked one on top of the other, the lid 8 of the currently lower container 1 in the stacking direction 2 lies between the bottom part 7 of the lower container 1 and the bottom part 7 of the upper container 1 lying on top. In particular the arrangement is such that the bottom surface 22 of the upper container 1 is in direct contact with the top panel 23 of the lid 8 lying below.

The hinge means 13 are expediently so fitted that the lid swivel axis 14 is assigned to the rear end face 16*b*. To open the container 1, the lid 8 may therefore be swivelled upwards in the area of its front side.

Where the terms "front side" and "rear side" are used below, they refer to those sides of the container 1 on which the front end face 16*a* and the rear end face 16*b* are located. In what follows, "transverse direction 24" describes a direction which is at right-angles to the stacking direction 2 and at the same time parallel to the front and rear end faces 16*a*, 16*b*. A direction at right-angles to the transverse direction 24 is described as the vertical direction 25.

Figure 7:
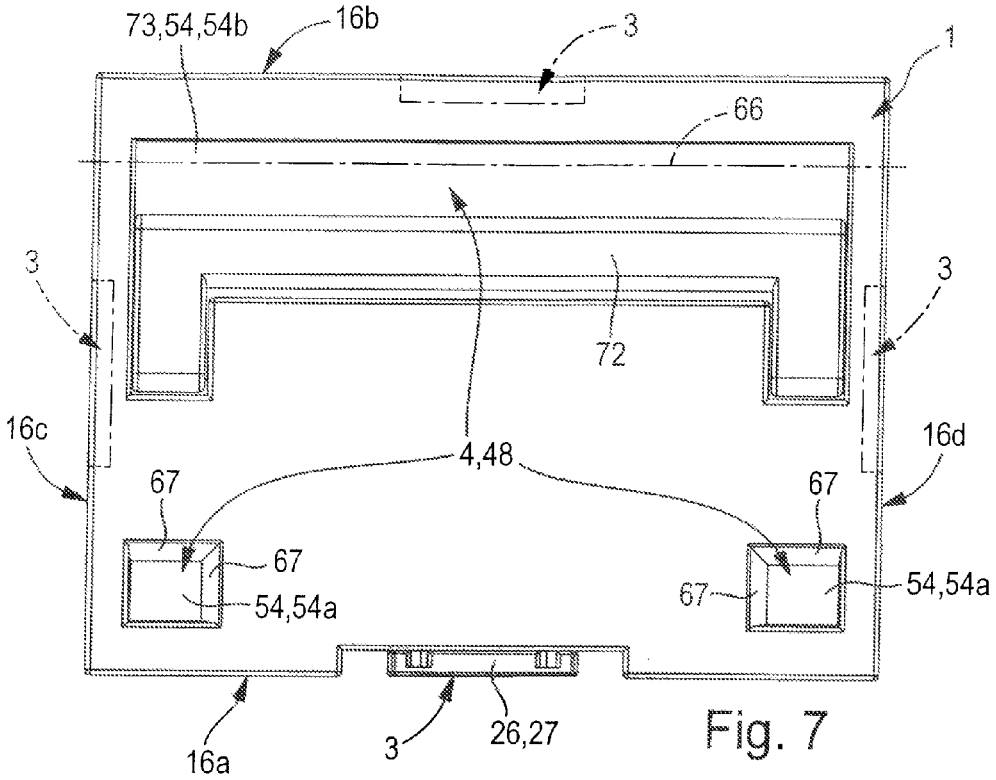
Figure 8:
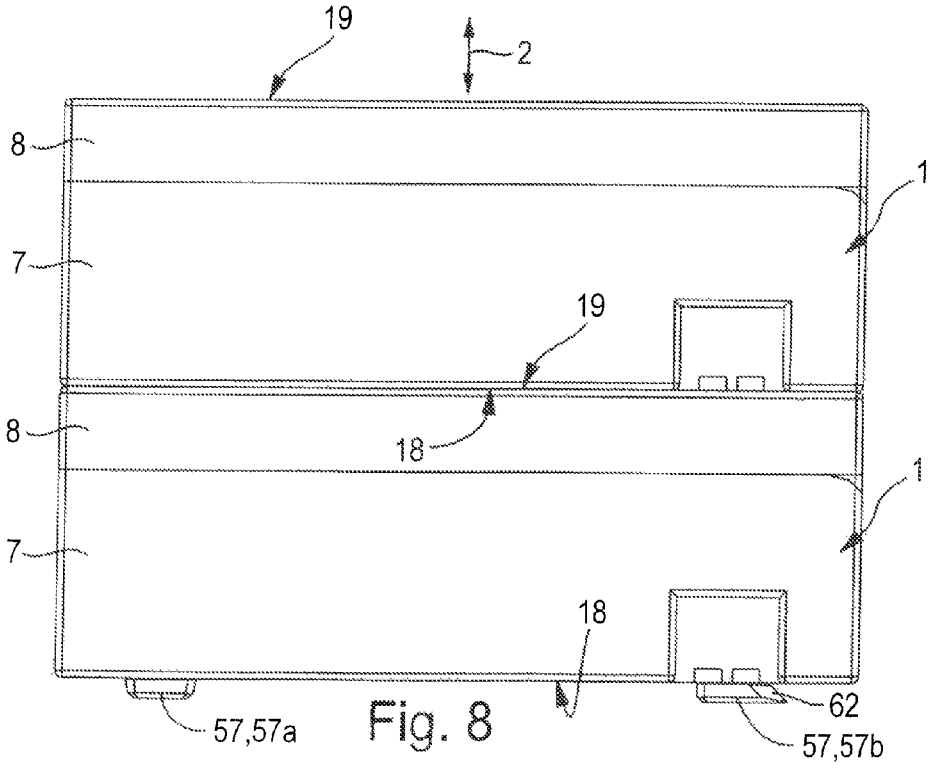

The connecting device 3 allows a releasable connection of a lower container 1 to an upper container 1 currently resting on top of it. As indicated in FIG. 7 by dot-dash lines, in each case at least one connecting device 3 could in principle be provided on several or even on all end faces 16*a*-16*d* of the container 1. Due to the additional provision of the engaging device 4, provision of the connecting device 3 in the embodiment is restricted to the front end face 16*a*, with preferably only a single connecting device 3 being provided, and placed centrally relative to the transverse direction 24, i.e. on the front end face 16*a* in the centre of its width. Handling is thereby greatly simplified.

A multiple arrangement of connecting devices 3, in particular operable independently of one another, is recommended especially if the load to be transferred through the connecting process is very high and is to be distributed over several points.

Figure 6:
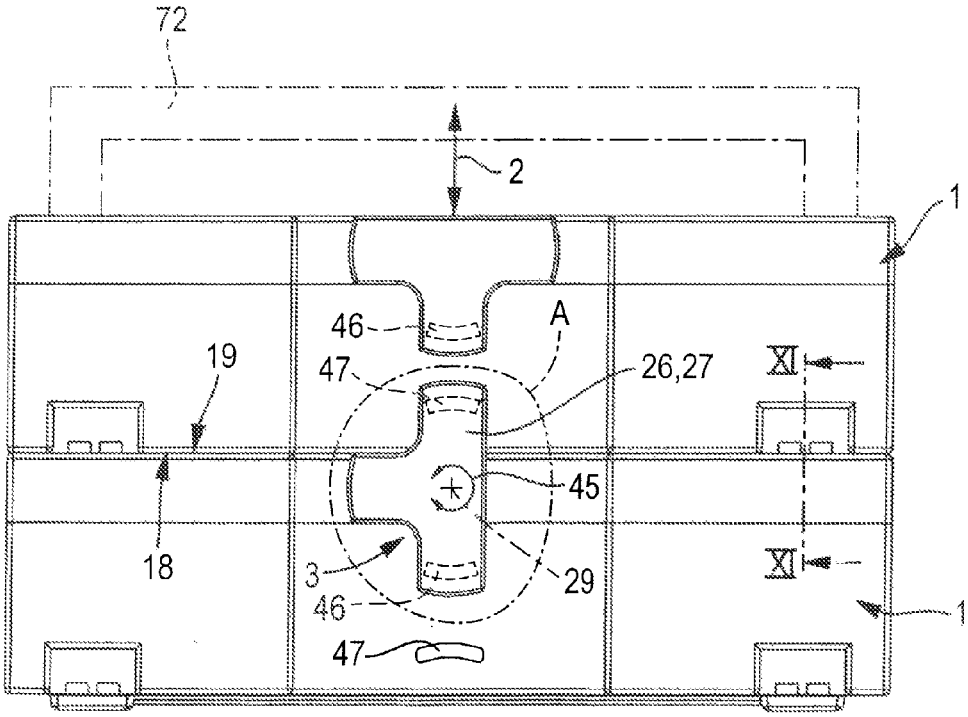
Figure 13:
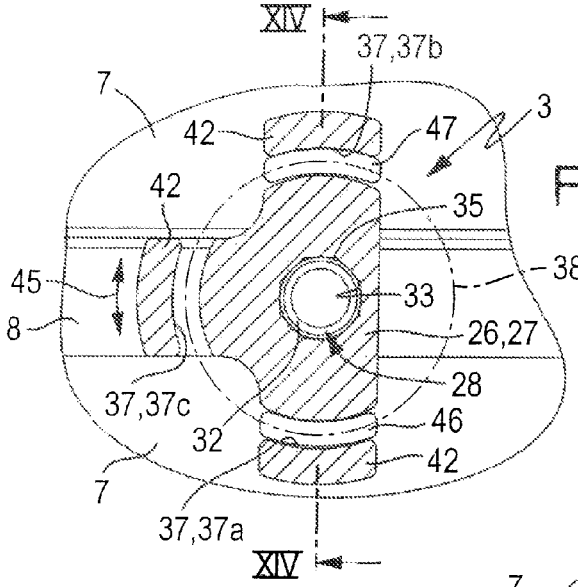
FIG. 13 the detail A bordered in FIGS. 5 and 6 of a container unit in the connected position of the connecting means, in a sectional view along section line XIII-XIII of FIGS. 5 and 14
Figure 15:
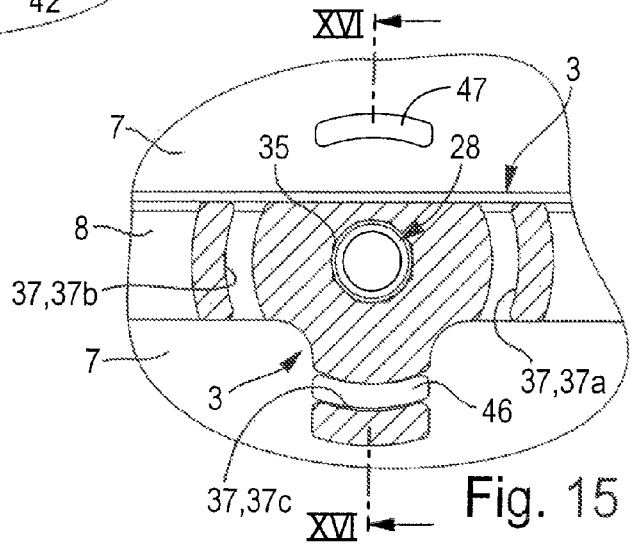
FIG. 15 the detail A of FIGS. 5 and 6 in the same sectional view as FIG. 13, with connecting means moved into the closed position and in a sectional view along section line XV-XV of FIG. 16
Figure 14:
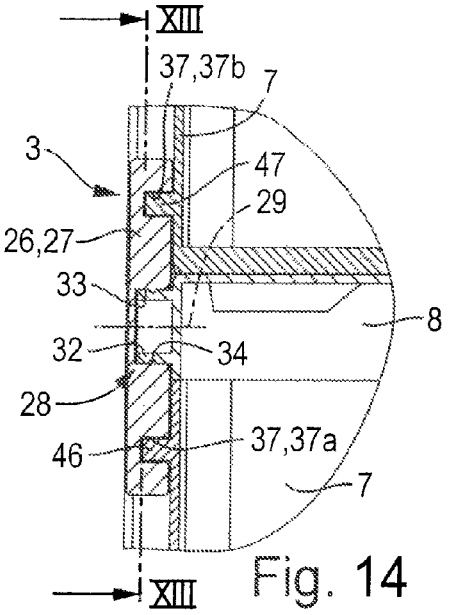
FIG. 14 the assembly of FIG. 13 in a section along section line XIV-XIV

The connecting device 3 has a connecting means 26, mounted on and movable relative to the lid 8, and movable into a connected position shown in the lower half of FIGS. 5 and 6, also in FIGS. 13 and 14. In this connected position it is simultaneously in such connecting engagement with the bottom parts 7 of both stacked containers 1 that the two bottom parts 7 may no longer be moved relative to one another in the stacking direction 2. The connecting means 26 prevents the lifting of the upper container, while in the opposite direction the fixing is effected by the reciprocal direct vertical support of the containers 1 between themselves.

Figure 12:
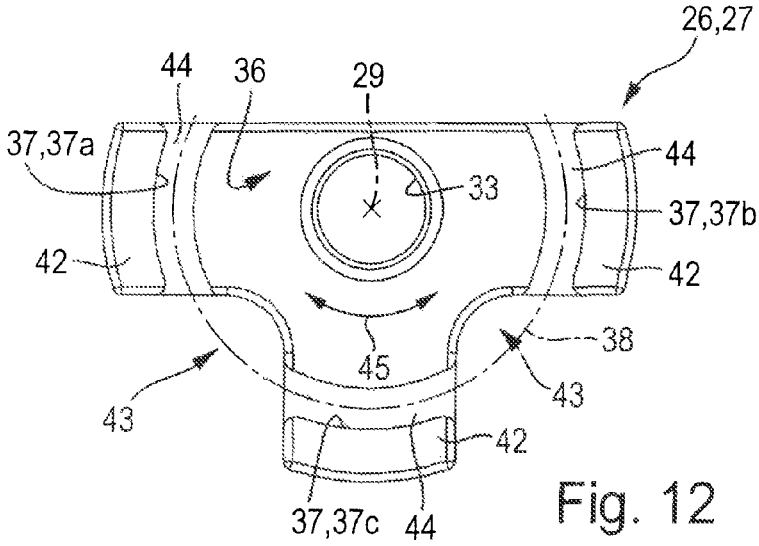

In principle one could imagine the connecting means 26 as an element with any desired and suitable degree of freedom of movement. Regarded as especially expedient, however is a design in the form of a rotating locking bolt 27, as is the case in the embodiment. FIG. 12 shows a detail view of a preferred version of the rotating locking bolt 27 seen from the rear.

Figure 16:
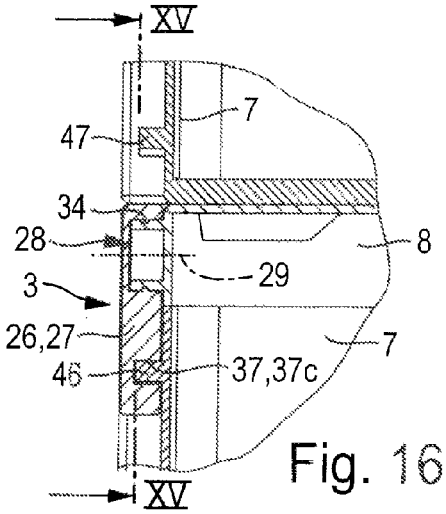
FIG. 16 the assembly of FIG. 15 in a section along section line XVI- XVI FIG. 17 the detail A of FIGS. 5 and 6 in a view comparable to FIGS. 13 and 15, with the connecting means shown in the open position FIG. 18 the detail A of FIGS. 5 and 6 in a view corresponding to FIGS. 13 and 15, with the connecting means shown in the semi-connected position FIG. 19 the container assembly of FIG. 5 in an open position of the lower container, with an upper container simultaneously connected to the lid of the lower container.

The rotating locking bolt 27 is expediently mounted rotatably on the front end face 16*a* of the lid 8, with the rotation axis 29 defined by the assigned pivotable mounting means 28 running in particular at right-angles to the front end face 16*a*. In the embodiment the pivotable mounting means 28 consist of a pivot pin 32, for example shaped like a pipe socket and extending forwards from the front end face 16*a* of the lid 8, and a bearing recess 33 formed in the rotating locking bolt 27, which is preferably in one piece and in particular made of plastic, and by which the rotating locking bolt 27 is rotatably attached to the pivot pin 32. The axial fixing may be effected by any desired securing means, for example by latching means 34 (FIGS. 14 and 16).

As indicated in FIGS. 13, 15, 17 and 18, the pivotable mounting means 28 may be provided with indexing means 35, which may be used to locate the rotating locking bolt 27 in various preferred positions non-rotatable relative to the lid 8, in such a way that it may be rotated further by applying only slightly increased force. This may for example involve latching means. Also conceivable are indexing means 35 of the kind based on a locking principle and requiring active unlocking with the finger of one hand.

The rotating locking bolt 27 has on its rear side 36 facing the body 6 several locking structures 37 evident from FIG. 12 and arranged with radial clearance from the rotation axis 29, wherein this radial clearance is expediently identical for all locking structures 37. These locking structures 37 are distributed in the peripheral direction of the rotation axis 29 and are spaced apart from one another, but lie preferably on a common circular arc 38, the centre of which lies on the rotation axis 29.

Preferably the locking structures 37 comprise at least three locking structures, designated below as first, second and third locking structures 37*a*, 37*b*, 37*c*. Of these, the first and second locking structures 37*a*, 37*b* preferably lie diametrically opposite relative to the rotation axis 29, i.e. they are located on opposite sides of the rotation axis 29. The circumferential offset of the first and second locking structures 37*a*, 37*b* with respect to the rotation axis 29 therefore amounts substantially to at least 180°. The third locking structure 37*c* is offset by 90° relative to the two aforementioned locking structures 37*a*, 37*b*.

The rotating locking bolt 27 is especially convenient to grip if it is roughly T-shaped, as depicted, in particular with three locking bolt arms 42, substantially of equal length, and extending radially outwards from the locking bolt centre with the bearing recess 33. Expediently, each locking bolt arm 42 is provided with one of the locking structures 37*a*, 37*b*, 37*c*. Between the locking bolt arm 42 with the third locking structure 37*c* and each of the other two locking bolt arms 42 there is expediently a gap 43, the purpose of which will be explained below.

Preferably the locking structures 37 are comprised in each case of the radially-outwards lying outer recess flanks, facing the rotation axis 29, of a slot-like recess 44 formed in the rear of the body of the rotating locking bolt 27. Each recess 44 expediently curves along the arc 38.

The outer locking flanks acting as locking structures 37 also have a correspondingly curved shape with the curve centres lying on the rotation axis 29.

If the rotating locking bolt 27 is rotated according to double arrow 45 around the rotation axis 29, the locking bolt arms 42 pivot around the rotation axis 29, whereat a locking bolt arm 42 momentarily extending upwards or downwards in the stacking direction 2 extends outwards in the corresponding direction over the lid 8. The distance between the locking structures 37 and the rotation axis 29 is therefore greater than the distance between the rotation axis 29 and the top and bottom of the lid 8.

As further components, the connecting device 3 has first and second anchoring means 46. 47, which are located on the front end face 16*a* of that bottom part 7 to which the lid 8 carrying the rotating locking bolt 27 also belongs. The two anchoring means 46, 47 are mounted in the stacking direction 2 beneath the lid 8, preferably with clearance, while in the stacking direction 2 they are expediently flush and in particular spaced apart from one another in such a way that the first anchoring means 46 are positioned closer to the lid 8 than the second anchoring means 47.

As complementary elements to the slot-like recesses 44, the anchoring means 46, 47 are each formed in the embodiment by a projection, in particular arc-shaped. The first anchoring means 46, which are therefore curved, are so arranged on the bottom part 7 that their curvature corresponds to that of the arc 38 and they are arranged exactly on this arc 38.

The curvature of the second anchoring means 47 is opposite to that of the first anchoring means 46. Consequently, the convex surfaces of the two anchoring means 46, 47 face one another. The curvature of the second anchoring means 47 is identical to that of the first anchoring means 46, while the second anchoring means 47 are so positioned with such clearance from the rotation axis 29 that the distance between the second anchoring means 47 of an upper container 1 from the rotation axis of the container 1 lying below is the same as the distance between the rotation axis 29 and the first anchoring means 46.

So, when two containers 1 rest one on top of the other, the first anchoring means 46 of the lower container 1 and the second anchoring means 47 of the upper container 1 lie together on the arc 38 (see FIG. 13).

A reverse arrangement would also be possible, to the effect that the anchoring means 46, 47 are in the form of slot-like recesses into which the anchoring structures 37 of the rotating locking bolt 27, formed by projections, are able to engage.

In principle it would also be possible to design the first and second anchoring means 46, 47 as a unit.

When two containers 1 rest one on top of the other, the rotating locking bolt 27 of the lower container 1 may be rotated into the connected position evident from FIGS. 5, 6, 13 and 14, in which the first locking structure 37*a* is in connecting engagement with the first locking means 46 of the lower bottom part 7, and there is at the same time connecting engagement between the second locking structure 37*b* located on the upwards extending locking bolt arm 42 and the second anchoring means 47 of the upper bottom part 7. A position in which the rotating locking bolt 27 is rotated through 180° brings the same result, only here the first and second locking structures 37*a*, 37*b* are transposed in respect of their interaction with the two anchoring means 46, 47.

In the connected position, the anchoring means 46, 47 are overlapped, on the sides facing in opposite directions relative to the stacking direction 2, by the first and second locking structures 37*a*, 37*b*, so that the bottom parts 7 may no longer be disconnected from one another in the stacking direction 2. Here the lid 8 of the lower container 1 may be clamped between the bottom parts 7 flanking it above and below.

Besides the connected position, the rotating locking bolt 27 may also be put into other rotary positions which meet a specific function. In this connection, the positioning is aided by the indexing means 35. A further such position is the closed position evident for example from FIGS. 1, 15 and 16, which is also present for the rotating locking bolt of the upper container 1 in FIGS. 5 to 10. The closed position differs from the connected position by a position rotated through 90°, so that the first and second locking structures 37*a*, 37*b* come to lie without effect in the area of the front end face 16*a* of the lid 8, and only the third locking structure 37*c*, located on a locking bolt arm 42 extending downwards into the closed position, is effective. This third locking structure 37*c* is in connecting engagement with the first anchoring means 46, so that the lid 8 is locked relative to the bottom part 7 and cannot be lifted. The locking force effective between the lid 8 and the bottom part 7 is here transferred on the part of the lid 8 via the pivotable mounting means 28, which however represents no further problem since only a closing force is involved, which is relatively small and places only a small load on the pivotable mounting means 28.

The design of the rotating locking bolt 27 is such that, in the closed position, it does not extend into that area in which the second anchoring means 47 of a further upper container 1 which may possibly be placed on this container are to be found. Especially advantageous is a a structure with the effect that the rotating locking bolt 27 in the closed position does not extend at all or else only slightly over the top side 19 of the lid 8.

On adoption of the closed position of the rotating locking bolt 27, a further container 1 may be placed at any time on the assigned container 1, and also removed again unimpeded.

The closed position of the rotating locking bolt 27 may therefore be used to disconnect the container unit. It may also be used for releasable locking of the lid 8, relative to the bottom part 7, of a container 1 to be used separately, so that the lid 8 is secured in the covering position. Such a situation is shown in FIG. 1.

As is clear, the locking structures 37 of the rotating locking bolt 27 always cooperate in both the connected position and also the closed position with the same first anchoring means 46 of the lower bottom part 7. The design cost is therefore relatively low.

Figure 17:
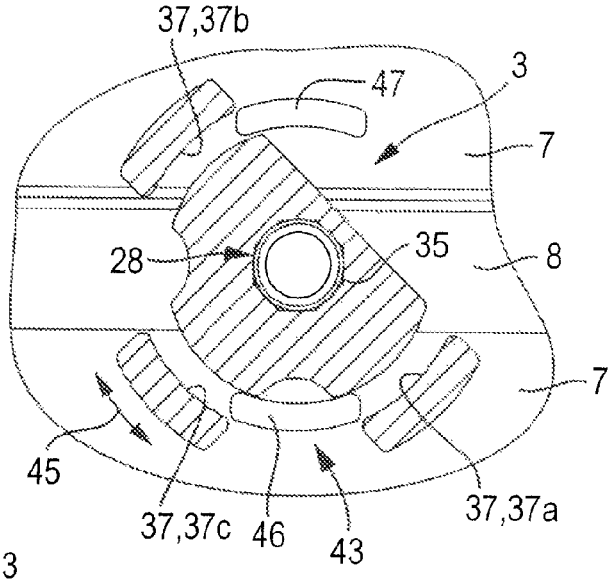

Another functional position of the rotating locking bolt 27 is shown in FIGS. 2 and 17. This involves an open position in which the locking between lid 8 and bottom part 7 is released so that the lid 8 may be swivelled up to open the container 1 as shown by arrow 15. Expediently this open position, as also the closed position explained above, simultaneously forms a release position with respect to the upper container resting on the container 1 and in which the locking engagement of the rotating locking bolt 27 is released in both the open position and also the closed position.

In the open position, the gaps 43 located between adjacent locking structures 37 acquire their importance. The width of these gaps 43 is at least as great as the width of the first anchoring means 46, while the rotating locking bolt 27 is so positioned in the open position that the gap 43 comes to lie in the area of the first anchoring means 46. In other words the first anchoring means 46 are therefore located in the gap 43, which is large enough to allow upwards swivelling of the lid 8, without this being prevented by the first anchoring means 46. In the open position, therefore, the first anchoring means 46 are entirely out of connecting engagement with any locking structures 37.

On account of the preferred symmetrical design of the rotating locking bolt 27, the latter may be put into two alternative open positions which, starting from the closed position, may be reached by rotating the rotating locking bolt 27 in one or the other direction, wherein the angle of rotation is preferably 45° in each case. If only one open position is provided, then one of the gaps 43 may be omitted.

Figure 18:
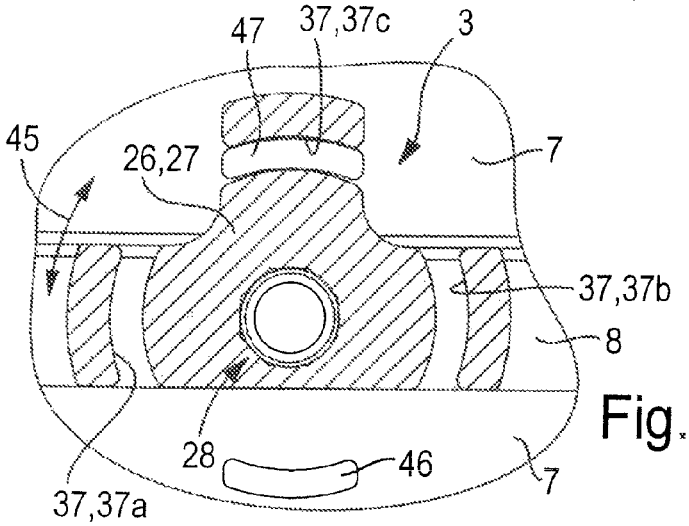

Finally, the rotating locking bolt 27 may also be brought into a functional position shown in FIG. 18 and described as the semi-connected position because, while the connecting engagement with the bottom part 7 belonging to the lid 8 is released, the connecting engagement with the bottom part 7 of the upper container 1 resting on the lower container 1 is not released. The semi-connected position is also evident once more in FIG. 19 in connection with the rotating locking bolt 27 belonging to the lower container 1.

In the embodiment, the semi-connected position is a position rotated through 90° relative to the connected position. Here the locking bolt arm 42 equipped with the third locking structures 37*c* extends upwards, in front of the front end face 16*a* of the bottom part 7 of the upper container 1. There the third locking structure 37*c* is in locking engagement with the second anchoring means 47. Relative to the first anchoring means 46, the locking engagement is cancelled, while the first and second locking structures 37*a*, 37*b* are in the same position as in the closed position according to FIG. 15, only interchanged in their orientation.

Figure 19:
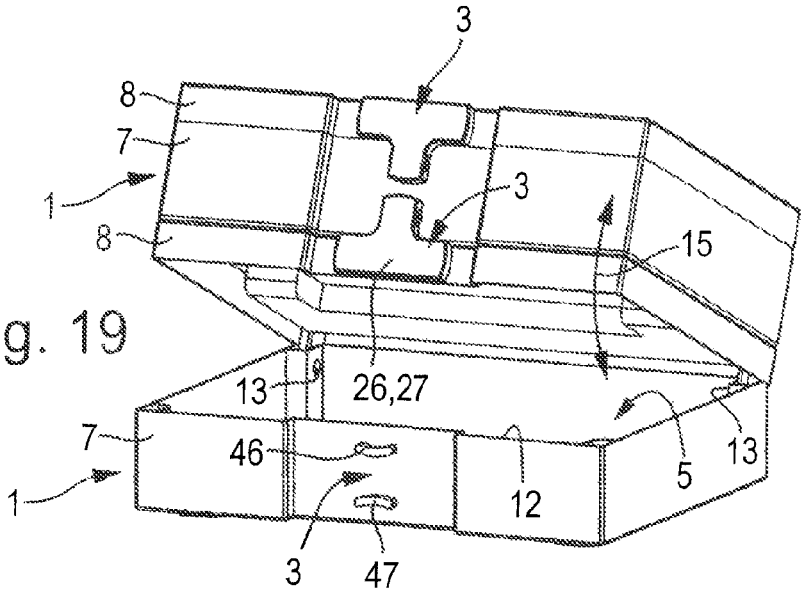

In the semi-connected position, the lid 8 which is no longer locked to the bottom part of the lower container 1 may be swivelled up as shown in FIG. 19, and specifically together with the one or more farther containers 1 mounted on this lid 8, which continue(s) to be locked to the lid 8 which may be swivelled upwards in the same manner as in the case of a connected position. The container unit is therefore not disassembled, while the lower container 1 may still be opened to give access to the storage space 5.

It goes without saying that the design of the rotating locking bolt 27 may deviate from that depicted; in particular it would be possible to provide additional wall structures covering the gaps 41 at the front, so that the rotating locking bolt 27 has a more uniform external contour, for example comparable to the shape of a circle segment.

The engaging device 4 which is also present contains a first engaging structure 48 located on the top side 19 of the container 1, and a second engaging structure 49 provided on the underside 18 of the container 1. In the embodiment, the first engaging structure 48 is located externally on the top panel 23 of the lid 8, and the second engaging structure 49 externally on the bottom surface 22 of the bottom part 7. The two engaging structures 48, 49 are so matched that, in the stacked state of two containers 1, the upwards facing first engaging structure 48 of the lower container 1 and the downwards facing second engaging structure 49 of the upper container 1 engage with one another. This reciprocal engagement has the effect that the stacked containers 1 are on the one hand supported mutually at right-angles to the stacking direction 2 and may not be displaced relative to one another. On the other hand, it is brought about that the engaging structures 48, 49 engage at least partly from behind at right-angles to the stacking direction in such a way that effective locking is provided in the stacking direction and prevents at least a vertically upwards directed lifting of at least a certain area of the upper container 1 from the lower contained.

In practice, the engaging structures 48, 49 are preferably so designed that they prevent lifting of the rear section 52 of the upper container 1, but on the other hand allow lifting of the front section 53 of the upper container 1. This circumstance is clear from FIG. 10. So that the front section 53 is also locked, unable to be lifted, to the lower container 1, and therefore the entire upper container 1 enters into a stable connection with the lower container 1, the connecting device or devices 3, already explained in detail, is or are provided. This connecting device 3, which rests expediently in the area of the front end face 16*a*, on assuming the connected position securely holds together the upper bottom part 7 and the lower bottom part 7, with the lower lid 8 interposed, in the manner described above.

If no connecting device 3 were provided, it could also be ensured through a suitable design of the first and second engaging structures 48, 49 that, in the stacked condition of two containers, the upper container 1 may not be lifted upwards in its entirety in the stacking direction 2. However, there are benefits in terms of handling as a result of the combination of the engaging device 4 and the connecting device 3.

The first engaging structure 48 consists of a multiplicity of engaging recesses 54 formed in the top side 19 of the lid 8 and distributed over the lid surface. The second engaging structure 49 consists of several engaging projections 55, expediently arranged with the same distribution as the engaging recesses 54 and projecting downwards over the expediently at least smooth outer base area 56 of the bottom surface 22.

Several of these engaging projections 55 form feet 57, expediently distributed at points over the underside 18, wherein the embodiment has altogether four such feet 57, placed in the corner zones of the outer base area 56 of the bottom surface 22, but here with a certain clearance in each case from the end faces 16*a*-16*d*.

When used individually, each container 1 may be stored stably on a floor with the help of the feet 57. The same applies to the use of a container 1 as lower container of a stacked container assembly. The feet 57 are expediently integral with the body 6, but may also if required be attached so as to be at least partly releasable, to facilitate replacement in case of wear.

Beneath the engaging recesses 54 are two elements 54*a* which are located in the two front corner areas of the preferred rectangular top side 19. A similar arrangement would also be possible for the engaging recesses assigned to the rear feet 57, but in the embodiment an advantageous variant has been chosen in which there is a single rear engaging recess 54*b* with dimensions such that both rear feet 57 can engage in it simultaneously.

As is evident in particular from FIGS. 1, 7 and 9, the rear engaging recess 54*b* may have an elongated shape with its long side running in the transverse direction 24 and extending parallel to the rear end face 16*b*. The front engaging recesses 54*a* on the other hand are, like the assigned front feet 57, punctiform in shape and therefore have a square outline.

In the embodiment, the two front feet are pure support feet 57*a*, with an outline complementary to that of the front engaging recesses 54*a* so that, when inserted in the front engaging recesses 54*a*, they rest on the inner side walls of the front engaging recesses 54*a*. By this means, the upper container 1 may no longer be shifted on the lower container 1 at right-angles angles to the stacking direction 2. The structuring of the support feet 57*a* and the front engaging recesses 54*a* is however such that there is no locking in the stacking direction 2, so that the front section 53 of the upper container 1 may be lifted at any time when the connecting means 26 are in the release position.

The rear feet 57 which cooperate with the preferred single rear engaging recess 54*b* are in contrast designed as locking feet 57*b*. Their special feature is that they function as rear-engaging elements of the second engaging structure 49 and are able to engage from the rear inside the rear engaging recess 54*b* designed for locking engagement at right-angles to the stacking direction 2, so that a locking engagement preventing relative movement in the stacking direction 2 is in force. The rear engaging recess 54*b* is therefore also described below as the locking engaging recess.

If each locking foot 57*b* is assigned a separate engaging recess 54, this is also in each case in the form of a locking engaging recess.

Figure 11:
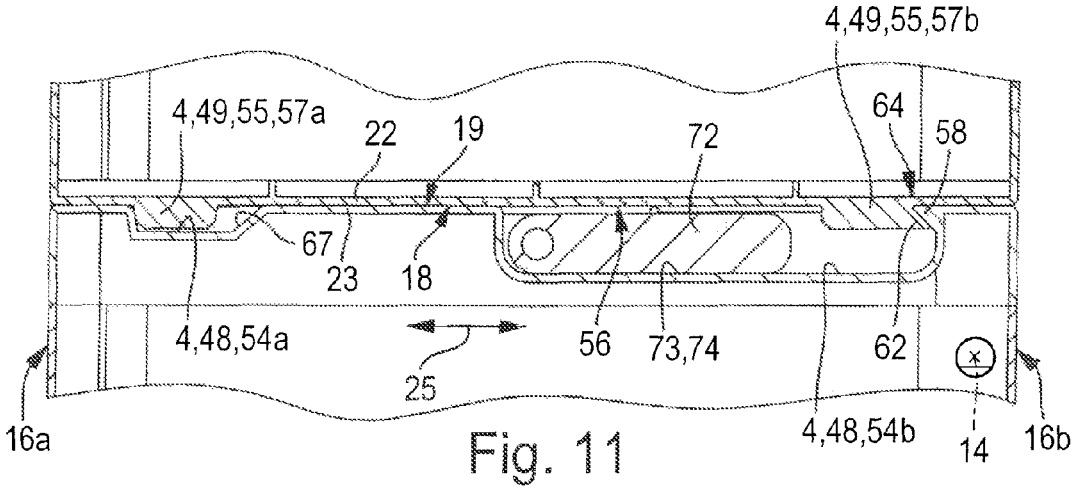

The rear engaging recess obtains its function as locking engaging recess 54*b* in particular through its design with a relief-cut cross-section, of which FIG. 11 shows an embodiment. The locking engaging recess 54*b* which is otherwise open at the top has, at least on its edge area adjacent to the rear end face 16*b*, a rear-engaging projection 58 which is preferably rib-like and extends forwards in the vertical direction 25. This leads to the locking engaging recess 54*b* having an opening cross-section which is smaller than the base area of the floor of the recess.

On its rear side facing the rear end face 16*b*, each locking foot 57*b* has a rear-engaging section 62, expediently with a wedge-shaped profile, so that in the transition zone to the outer base area 56 of the bottom surface 22 there is a gap with a cross-section complementary to the rear-engaging projection 58 (FIG. 11).

The dimensions of the opening of the rear engaging recess 54*b* are greater in the vertical direction 25 than those of each locking foot 57*b*. The latter may therefore be inserted easily from above into the locking engaging recess 54*b*.

Figure 10:
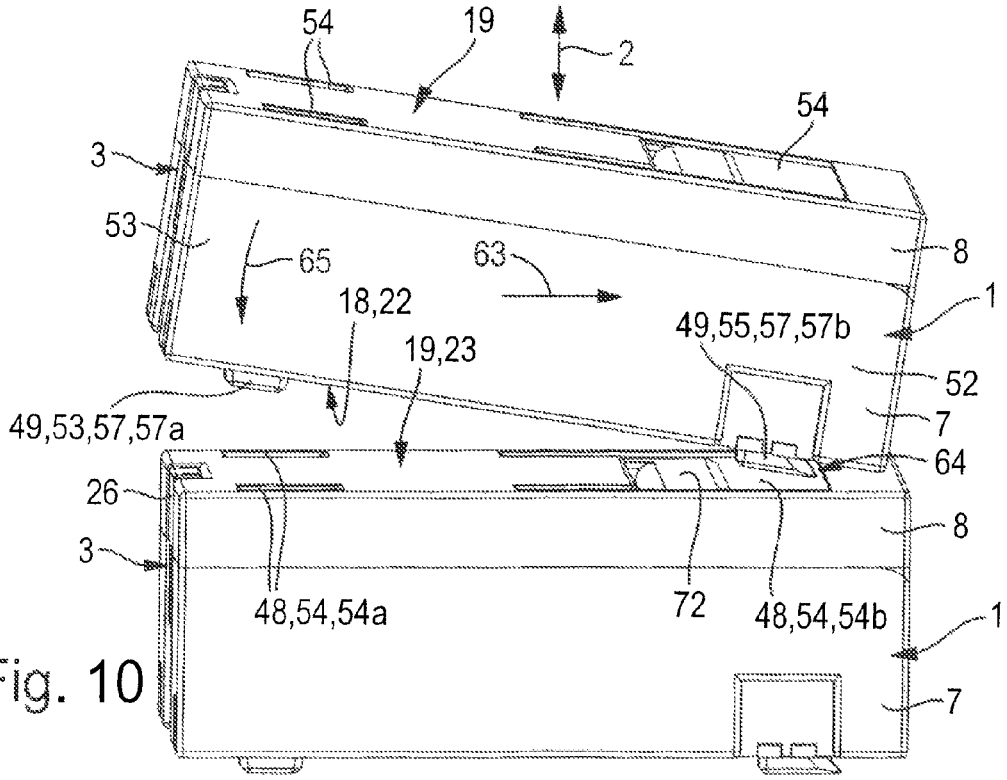

To fit an upper container 1 on a lower container 1, the upper container 1 is set down as shown in FIG. 10 in an inclined position, and with the downwards tilted rear section 52 leading, on to the top side 19 of the lower container 1, whereby the locking feet 57*b* dip into the locking engaging recess 54*b*. At the same time or afterwards, the upper container 1 is pressed or pushed downwards as indicated by arrow 63, so that the rear-engaging sections 62 come into locking engagement with the rear-engaging projection or projections 58. The area in which this locking engagement occurs may be described as the locking area 64.

In a further step, the front section 53 of the upper container 1 is swivelled downwards as shown by arrow 65, whereby the rear-engaging structures in the locking area 64 define a pivot axis 66, outlined in FIG. 7, for the aforementioned swivelling process.

On further swivelling of the front section 53 on to the top side 19 of the lower container 1,the support feet 57*a* dip into the assigned front engaging recesses 54*a* and finally complete the mutual engagement of the engaging structures 48, 49.

The rear section 52 of the upper container 1 is secured against vertical lifting by the locking engagement between the locking feet 57*b* and the locking engaging recess 54*b*. The corresponding vertical securing of the front section 53 is obtained by rotating the connecting means 26 into the connected position.

Insertion of the support feet 57*a* into the front engaging recesses 54*a* may be aided by making the side wall of the front engaging recesses 54*a* at least partly an inclined sliding surface 67. The front engaging recesses 54*a* therefore have in the area of their opening a larger cross-section than at their bottom surface, with the difference in cross-section being bridged by the inclined sliding surfaces 67. Consequently, automatic centring take place when the upper container is put on.

Figure 4:
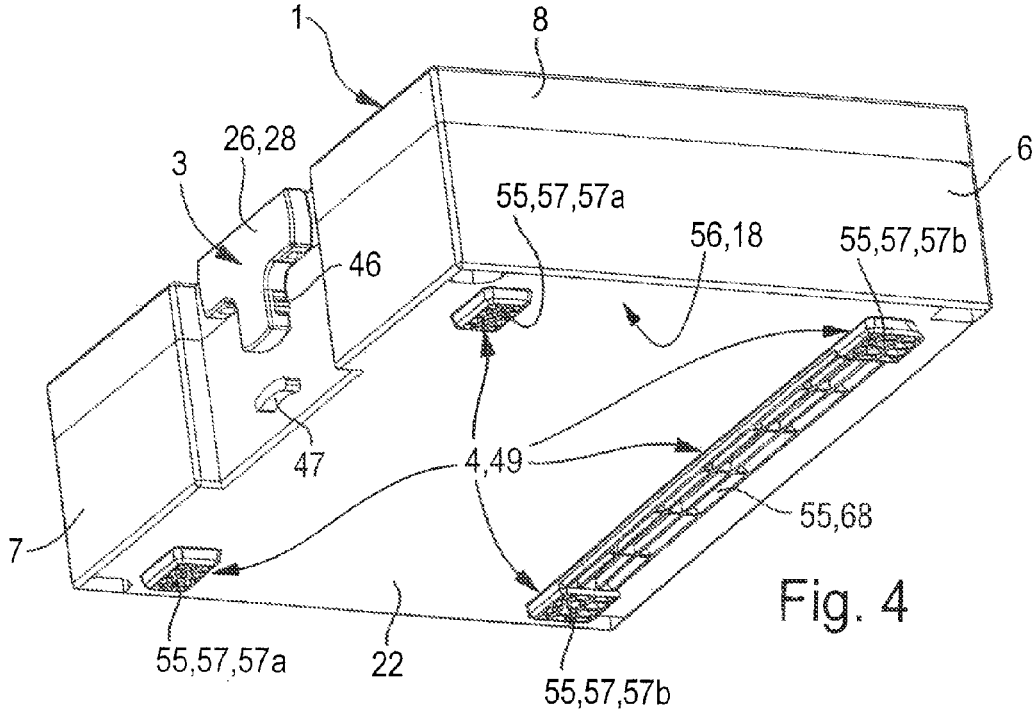
FIG. 4 an oblique view of the underside of the container

From FIG. 4 it is clear that, between the two locking feet 57*b* arranged with clearance from one another in the transverse direction 24, there may extend an additional locking strip 68 which also has a rear-engaging section 62 similar to that of the locking feet 57*b* and which expediently bridges the entire gap between the two locking feet 57*b*. This locking strip 68 also forms a rear-engaging element of the second engaging structure 49 which additionally acts on the locking feet 57*b* and increases the length of the locking contact, so that greater load-bearing capacity is obtained.

The height of the locking strip 68 measured in the stacking direction 2 is expediently less than that of the locking feet 57*b*, so that the latter extend down beyond the locking strip 68. Here, it is advantageous for the locking strip 68 and the locking feet 57*b* to be made as one-piece. It may be joined in particular integrally to the body of the bottom part 7, in a similar manner to the feet 57.

It is also quite easily possible to have a different number of feet 57 from the embodiment. For example a single strip-like locking foot 57*b* could be provided at the rear, i.e. comparable to an arrangement in which the locking strip 68 has the same height as the locking feet 57*b*.

So that the container 1 or the container unit may be transported easily, the container 1 expediently has a carrying handle 72 on its top. Expediently this carrying handle 72 is mounted on the lid. Moreover it is advantageously so designed that it may adopt either an out-of-use position, evident from the drawing, in which it is swivelled on to the top side 19, or a position of use indicated in FIG. 6, in which it is swivelled upwards and therefore extends up over the top side 19. It is preferably a bow- or U-shaped carrying handle 72.

So that the carrying handle 72 does not impede the stacking of the containers 1 a locating recess 73, open at the top, is formed in the top side 19 of the lid 8. The carrying handle 72 comes to lie in this recess when not in use. Here it is of advantage if this locating recess 73 is formed directly by the locking engaging recess 54*b* which is of matching size.

In the embodiment, the aforementioned locking engaging recess 54*b* simultaneously forms a handgrip recess 74 open on the top side 19. This gives the option of transporting a single container in an upright position rotated through 90° relative to the normal position of use, like a briefcase, and in so doing engaging from above with one hand in the handgrip recess 74, whereby the rear-engaging projection 58 may be encompassed by the fingers, so that more secure transport is possible.

Varying from the embodiment, the locking engaging feet 54*b* could also be so designed that their rear-engaging section 62 is oriented towards the front. In this case, the rear-engaging projection 58 would also be located on the edge section lying closer to the front end face 16 of at least one locking engaging recess 54*b*, and would face rearwards.

In the embodiment, the entire load-bearing force between two vertically-connected containers 1 is transferred via a three-point connection. The three connection points are comprised of locking measures in the area of the two locking feet 57*b* and the rotating locking bolt 27 fitted with clearance from the locking area 64. A certain surface force may also be transferred by the locking strip 68.

There is no problem at all in providing containers 1 of varying overall height, and which have the same connecting devices 3 and engaging devices 4 as the described container 1. By this means it is also possible to stack containers 1 of varying size without difficulty in any desired order, and combine them to form a container unit.

The combined existence of the connecting device or devices 3 and the engaging device 4 is especially advantageous, however the container 1 may in principle also have no engaging device 4 and/or an engaging device differing from the type described.

The invention claimed is:

1. A container assembly, with at least one stackable container which has a bottom part with an opening, and a lid assigned to the opening of the bottom part and movable relative to the bottom part for either opening or closing the opening, and designed for the vertical stacking of several containers in such a way that the lid of a lower container comes to lie between the bottom part of the lower container and an upper container positioned immediately above, wherein the at least one stackable container is provided with at least one connecting device which has a movable connecting means, by which the bottom parts of containers resting directly on top of one another may be connected releasably together to obtain a container unit comprised of several containers, and wherein the movable connecting means comprises:

a rotating locking bolt mounted on the lid, the locking bolt being rotatable with respect to the lid between a connected position and an open position;

first and second anchoring means provided on the bottom part to interact with the rotating locking bolt, the first and second anchoring means being spaced apart in the stacking direction of the container, whereby the first anchoring means are disposed closer to the lid than the second anchoring means in such a way that, when the rotating locking bolt is in the connected position, the rotating locking bolt of the lower of two stacked containers is simultaneously in connecting engagement with the first anchoring means provided on the bottom part of the lower container and with the second anchoring means provided on the bottom part of the upper container, and, when the rotating locking bolt is in the open position, the rotating locking bolt is entirely out of connecting engagement with the first anchoring means provided on the bottom part of the lower container for releasing the locking between the lid and the bottom part, while the rotating locking bolt is still in engagement with the lid; and a pivot pin extending outwardly from a front face of the lid, the pivot pin defining a rotation axis for the rotating locking bolt and the rotating locking bolt being rotatably mounted on the pivot pin, wherein the rotating locking bolt comprises a plurality of locking slots adapted for engagement with the anchoring means of the bottom part, the locking slots being spaced apart from one another on a common circular arc, the center of the circular arc being the rotation axis defined by the pivot pin.

2. The container assembly according to claim 1, wherein the movable connecting means of at least one connecting device is movable into a closed position deviating from the connected position, in which it is disconnected from an upper container mounted over the assigned lid and is simultaneously in connecting engagement with the bottom part located below the lid in such a way that the lid is locked in a covering position relative to this bottom part which closes the opening of the bottom part.

3. The container assembly according to claim 1, wherein the movable connecting means of at least one connecting device is movable into a semi-connected position deviating from the connected position, in which it is in connecting engagement with the bottom part of an upper container mounted above the assigned lid, and is simultaneously disconnected from the bottom part located below the lid, so that it is possible to lift the lid together with the container mounted above the lid from the bottom part located below the lid.

4. The container assembly according to claim 3, wherein the movable connecting means of at least one connecting device is in the form of a rotating locking bolt mounted rotatably on the lid, and anchoring means provided on the bottom part to interact with the rotating locking bolt are arranged in such a way that the rotating locking bolt of the lower of two stacked containers, on assuming the connected position, is in simultaneous connecting engagement with the anchoring means of the bottom parts of both containers, and wherein the rotating locking bolt in the semi-connected position altogether assumes a rotated position deviating from the connected position relative to the lid.

5. The container assembly according to claim 4, wherein the rotated positions in the connected position and in the semi-connected position are rotated through 90° relative to each other.

6. The container assembly according to claim 1, wherein several connecting devices are provided, distributed at several points along the periphery of the container, and operable independently of one another.

7. The container assembly according to claim 1, wherein the rotating locking bolt, on assuming the connected position, has locking structures, which are in connecting engagement with the anchoring means of two stacked containers.

8. The container assembly according to claim 7, wherein the anchoring means are in the form of projections.

9. The container assembly according to claim 8, wherein the locking structures are portions of slot-like recesses, or vice-versa.

10. The container assembly according to claim 7, wherein both the anchoring means and also the locking structures are curved, with bow centers lying on the rotation axis of the rotating locking bolt.

11. The container assembly according to claim 1, wherein the connecting device or devices is or are located on an end face of the container oriented at right-angles to the stacking direction of the container, whereby the rotating locking bolt is rotatable relative to a rotation axis at right-angles to this end face.

12. The container assembly according to claim 1, wherein the movable connecting means of at least one connecting device is movable into a closed position deviating from the connected position, in which it is disconnected from an upper container mounted over the assigned lid and is simultaneously in connecting engagement with the bottom part located below the lid in such a way that the lid is locked in a covering position relative to this bottom part which closes the opening of the bottom part, and wherein, in the closed position, the rotating locking bolt assumes a rotated position relative to the lid, which deviates from the connected position.

13. The container assembly according to claim 12, wherein the rotating locking bolt has, offset in its direction of rotation, locking structures which in the connected position and in the closed position are alternately in connecting engagement with the same anchoring means located on the bottom part.

14. The container assembly according to claim 13, wherein the locking structures are so offset relative to one another in the direction of rotation of the rotating locking bolt that the rotating locking bolt may be rotated into an open position in which the anchoring means fitted to the bottom part and cooperating with the rotating locking bolt in the connected position and in the closed position lie between the locking structures, thereby cancelling out the connecting engagement, to allow raising of the lid from the bottom part to open the opening of the bottom part.

15. The container assembly according to claim 1, wherein the movable connecting means is in the form of a rotating locking bolt mounted rotatably on the lid, which may be rotated into several different rotated positions, including at least a connected position, a closed position connecting the lid only with the bottom part lying below it, and an open position disconnecting the lid from the bottom part lying below it.

16. The container assembly according to claim 15, wherein the rotating locking bolt is also rotatable to a semi-connected position disconnecting the lid from the bottom part lying below it and simultaneously connecting it to the bottom part lying above it.

17. The container assembly according to claim 1, wherein the lid is mounted pivotably on the bottom part with clearance from the front end face of the container in such a way that, with the movable connecting means of at least one connecting device moved into an open position, it may be swiveled upwards in the front section relative to the bottom part.

18. The container assembly according to claim 17, wherein it has only a single connecting device, which is located in the center of the width of a front end face of the container.

19. The container assembly according to claim 1, wherein a first engaging structure is provided on the top side of the lid, and a second engaging structure on the underside of the bottom part, whereby the two engaging structures are so matched to one another that, when two containers are resting on top of one another, the first engaging structure lying on top of the lower container, and the second engaging structure lying below of the upper container, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container only in certain areas, so that the upper container may be swiveled up around the locking area defined by the rear-engaging elements, whereby the connecting device or devices is or are arranged with clearance from the locking area and, in the connected position of its coupling means, prevent the upper container from being swiveled up from the lid of the lower container.

20. The container assembly according to claim 19, wherein the engaging structures are so designed that the fitting of an upper container on to a lower container to obtain the locking effected in the stacking direction by the engaging structures may be carried out by placing the upper container in an inclined position relative to the lower container until there is mutual engagement of the engaging structures, and then swiveling the upper container on to the lower container around a swivel axis defined by the engaging structures which engage themselves behind.

21. The container assembly according to claim 19, wherein the first engaging structure consists of engaging recesses located on the top side of the container, and the second engaging structure of engaging projections located on the underside of the container, while the container has distributed on its underside several downwards projecting feet which belong to the second engaging structure and form at least partly its elements.

22. The container assembly according to claim 21, wherein at least one foot is designed as a locking foot forming a rear-engaging element of the second engaging structure, and at least one other foot is located with clearance from the locking foot in the area of the container capable of swiveling upwards, and forms a pure support foot not used for vertical locking.

23. The container assembly according to claim 22, wherein the second engaging structure has two locking feet spaced apart and each forming a rear-engaging element.

24. The container assembly according to claim 22, wherein the locking foot or feet has or have a wedge-shaped profiled rear-engaging section for engaging behind the first engaging structure.

25. The container assembly according to claim 24, wherein the wedge-shaped profiled rear-engaging section engages behind the first engaging structure and faces away from the support foot or feet.

26. The container assembly according to claim 22, wherein the first engaging structure has for interaction with the locking feet at least one locking engaging recess with a relief-cut cross-section, on the edge of which is provided a rear-engaging projection which may be engaged from the rear by a locking foot dipping into the locking engaging recess.

27. The container assembly according to claim 22, wherein the side wall of at least one engaging recess serving to accommodate a support foot is designed at least partly as an inclined sliding surface to assist the dipping-in of the support foot.

28. The container assembly according to claim 19, wherein at least one engaging recess of the first engaging structure is designed to accommodate simultaneously two of the spaced apart locking feet acting as rear-engaging elements.

29. The container assembly according to claim 19, wherein there is provided on the top side of the container a carrying handle which may be swiveled relative to the body of the container and which, in an out-of-use position, may be swiveled into a locating recess on the top side of the container, whereby this locating recess is formed directly by an engaging recess of the first engaging structure.

30. The container assembly according to claim 29, wherein the locating recess is formed by a locking engaging recess forming the rear-engaging elements of the first engaging structure.

31. The container assembly according to claim 19, wherein at least one engaging recess simultaneously forms a handgrip recess which may be used for carrying the container.

32. The container assembly according to claim 1, wherein it has at least two containers which may be stacked one on top of the other and connected releasably together to form a container unit.

33. A container assembly, with at least one stackable container which has a bottom part with an opening, and a lid assigned to the opening of the bottom part and movable relative to the bottom part for either opening or closing the opening, and designed for the vertical stacking of several containers in such a way that the lid of a lower container comes to lie between the bottom part of the lower container and an upper container positioned immediately above, wherein the at least one stackable container is provided with at least one connecting device which has a movable connecting means, by which the bottom parts of containers resting directly on top of one another may be connected releasably together to obtain a container unit comprised of several containers, and wherein the movable connecting means is mounted on the lid of the container and, to connect the container to a container placed on top of it, may be moved relative to the lid into a connected position in which it is simultaneously in connecting engagement with the bottom parts of both stacked containers, and wherein a first engaging structure is provided on the top side of the lid, and a second engaging structure is provided on the underside of the bottom part, whereby the two engaging structures are so matched to one another that, when two containers are resting on top of one another, the first engaging structure lying on top of the lower container, and the second engaging structure lying below of the upper container, engage in one another in such a way that the two containers are on the one hand secured against shifting relative to one another at right-angles to the stacking direction and on the other hand, due to rear-engaging elements of the engaging structures engaging from behind at right-angles to the stacking direction, there exists between the containers a locking which prevents lifting of the upper container from the lower container only in certain areas, so that the upper container may be swiveled up around the locking area defined by the rear-engaging elements, whereby the connecting device or devices is or are arranged with clearance from the locking area and, in the connected position of its coupling means, prevent the upper container from being swiveled up from the lid of the lower container, and wherein the first engaging structure comprises engaging recesses located on the top side of the container, and the second engaging structure comprises engaging projections located on the underside of the container, while the container has distributed on its underside several downwards projecting feet which belong to the second engaging structure and form at least partly its elements, and wherein at least one foot is designed as a locking foot forming a rear-engaging element of the second engaging structure, and at least one other foot is located with clearance from the locking foot in the area of the container capable of swiveling upwards, and forms a pure support foot not used for vertical locking, and wherein the second engaging structure has two locking feet spaced apart and each forming a rear-engaging element, and wherein, between the two locking feet, there extends a locking strip which, in the stacked condition of two containers is also in locking engagement with the rear-engaging elements of the first engaging structure.

34. The container assembly according to claim 33, wherein the movable connecting means of at least one connecting device is in the form of a rotating locking bolt mounted rotatably on the lid, and anchoring means provided on the bottom part to interact with the rotating locking bolt are arranged in such a way that the rotating locking bolt of the lower of two stacked containers, on assuming the connected position, is in simultaneous connecting engagement with the anchoring means of the bottom parts of both containers.

35. The container assembly according to claim 34, wherein at least one connecting device has, located on the bottom part and spaced apart in the stacking direction of the container, first and second anchoring means, of which the first anchoring means are placed closer to the lid than the second anchoring means in such a way that the rotating locking bolt of the lower of two stacked containers, on assuming the connected position, is in connecting engagement on the one hand with the first anchoring means provided on the bottom part of the lower container, and on the other hand with the second anchoring means provided on the bottom part of the upper container.

36. A container assembly, with at least one stackable container which has a bottom part with an opening, and a lid assigned to the opening of the bottom part and movable relative to the bottom part for either opening or closing the opening, and designed for the vertical stacking of several containers in such a way that the lid of a lower container comes to lie between the bottom part of the lower container and an upper container positioned immediately above, wherein the at least one stackable container is provided with at least one connecting device which has a movable connecting means, by which the bottom parts of containers resting directly on top of one another may be connected releasably together to obtain a container unit comprised of several containers, and wherein the movable connecting means comprises:

a rotating locking bolt mounted on the lid, the locking bolt being rotatable with respect to the lid between a connected position and an open position;

first and second anchoring means provided on the bottom part to interact with the rotating locking bolt, the first and second anchoring means being spaced apart in the stacking direction of the container, whereby the first anchoring means are disposed closer to the lid than the second anchoring means in such a way that, when the rotating locking bolt is in the connected position, the rotating locking bolt of the lower of two stacked containers is simultaneously in connecting engagement with the first anchoring means provided on the bottom part of the lower container and with the second anchoring means provided on the bottom part of the upper container, and, when the rotating locking bolt is in the open position, the rotating locking bolt is entirely out of connecting engagement with the first anchoring means provided on the bottom part of the lower container for releasing the locking between the lid and the bottom part, while the rotating locking bolt is still in engagement with the lid; and a pivot pin extending outwardly from a front face of the lid, the pivot pin defining a rotation axis for the rotating locking bolt and the rotating locking bolt being rotatably mounted on the pivot pin, wherein the rotating locking bolt comprises a plurality of locking slots adapted for engagement with the anchoring means of the bottom part, the locking slots being spaced apart from one another on a common circular arc, the center of the circular arc being the rotation axis defined by the pivot pin, and wherein the rotating locking bolt has three locking bolt arms defining a T-shape, each arm having one of the plurality of locking slots.

37. A container assembly with at least one stackable container designed for the vertical stacking of several containers, the at least one stackable container comprising:

a bottom part defining an opening;

a lid attached to the bottom part adjacent the opening, the lid being movable relative to the bottom part for either opening or closing the opening in such a way that the lid of a lower container comes to lie between the bottom part of the lower container and an upper container positioned immediately above upon vertical stacking of several containers;

a rotating locking bolt mounted on the lid, the locking bolt being rotatable with respect to the lid between a connected position, a semi-connected position and a closed position; and anchoring means provided on the bottom part to interact with the rotating locking bolt, wherein, when the rotating locking bolt is in the connected position, the rotating locking bolt of the lower container of two stacked containers is in simultaneous connecting engagement with the anchoring means of the bottom parts of both containers, whereby the upper container and the lower container are connected releasably together to obtain a container unit, and wherein, when the rotating locking bolt is in the semi-connected position, the rotating locking bolt of the lower container of two stacked containers is in connecting engagement with the anchoring means of the bottom part of an upper container mounted over the assigned lid, and is simultaneously disconnected from the anchoring means of the bottom part of the lower container, so that it is possible to lift the lid of the lower container together with the upper container mounted above the lid from the bottom part of the lower container, and wherein, when the rotating locking bolt is in the closed position, the rotating locking bolt of the lower container of two stacked containers is disconnected from the anchoring means of the bottom part of an upper container mounted over the assigned lid, and is simultaneously in connecting engagement with the anchoring means of the bottom part of the lower container in such a way that the lid of the lower container is locked in a covering position relative to the bottom part which closes the opening of the bottom part, and wherein the rotating locking bolt is further rotatable to an open position, wherein, when the rotating locking bolt is in the open position, the rotating locking bolt is entirely out of connecting engagement with the anchoring means provided on the bottom part of the lower container for releasing the locking between the lid and the bottom part, while the rotating locking bolt is still in engagement with the lid.

38. The container assembly according to claim 37, further comprising a pivot pin extending outwardly from a front face of the lid, the pivot pin defining a rotation axis for the rotating locking bolt and the rotating locking bolt being rotatably mounted on the pivot pin.

39. The container assembly according to claim 38, wherein the rotating locking bolt comprises a plurality of locking slots adapted for engagement with the anchoring means of the bottom part, the locking slots being spaced apart from one another on a common circular arc, the center of the circular arc being the rotation axis defined by the pivot pin.

40. A container assembly with at least one stackable container designed for the vertical stacking of several containers, the at least one stackable container comprising:

a bottom part defining an opening and having a front face;

a lid attached to the bottom part adjacent the opening, the lid having a front face and being pivotably movable relative to the bottom part about a pivot axis for either opening or closing the opening in such a way that the lid of a lower container comes to lie between the bottom part of the lower container and an upper container positioned immediately above upon vertical stacking of several containers, the pivot axis of the lid being spaced from and parallel with the front face of the bottom part and the front face of the lid;

a rotating locking bolt mounted on the front face of the lid, the locking bolt being rotatable with respect to the lid about a rotation axis between a connected position and an open position, the rotation axis of the rotating locking bolt being perpendicular to the pivot axis of the lid; and first and second anchoring means provided on the front face of the bottom part to interact with the rotating locking bolt, the first and second anchoring means being spaced apart in the stacking direction of the container, whereby the first anchoring means is disposed closer to the lid than the second anchoring means in such a way that, when the rotating locking bolt is in the connected position, the rotating locking bolt of the lower of two stacked containers is simultaneously in connecting engagement with the first anchoring means provided on the bottom part of the lower container and with the second anchoring means provided on the bottom part of the upper container, and, when the rotating locking bolt is in the open position, the rotating locking bolt is entirely out of connecting engagement with the first anchoring means provided on the bottom part of the lower container for releasing the locking between the lid and the bottom part, while the rotating locking bolt is still in engagement with the lid.

41. The container assembly according to claim 40, comprising only a single rotating locking bolt, the single rotating locking bolt being disposed in the center of the width of the front face of the lid and the first and second anchoring means being disposed in the center of the width of the front face of the bottom.

* * * * *

UNITED STATES PATENT AND TRADEMARK OFFICE

CERTIFICATE OF CORRECTION

PATENT NO. : 8,875,888 B2
APPLICATION NO. : 13/061161
DATED : November 4, 2014
INVENTOR(S) : Koenig et al.

It is certified that error appears in the above-identified patent and that said Letters Patent is hereby corrected as shown below:

ON THE TITLE PAGE:

IN THE ABSTRACT:

(57), Line 3: now reads "on top thereof Several containers"
should read -- on top thereof. Several containers --

IN THE SPECIFICATION:

Column 11, line 24: now reads "or more farther containers"
should read -- or more further containers --

Column 11, line 56: now reads "the lower contained."
should read -- the lower container 1. --

Column 12, lines 51-52: now reads "right-angles angles to the"
should read -- right-angles to the --

Signed and Sealed this
Fifteenth Day of September, 2015

Michelle K. Lee

Michelle K. Lee
*Director of the United States Patent and Trademark Office*